US007832604B2

(12) United States Patent
Gouldson

(10) Patent No.: US 7,832,604 B2
(45) **Date of Patent: *Nov. 16, 2010**

(54) VARIABLE LENGTH COORDINATE SET HANGER

(75) Inventor: Stanley F. Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/676,669

(22) Filed: Feb. 20, 2007

(65) Prior Publication Data

US 2007/0199964 A1 Aug. 30, 2007

Related U.S. Application Data

(60) Provisional application No. 60/775,310, filed on Feb. 21, 2006.

(51) Int. Cl.
*A41D 27/22* (2006.01)

(52) U.S. Cl. ..... 223/88; 223/85; 223/92

(58) Field of Classification Search ..... 223/85, 223/88, 91, 92, 93, 95, 96, DIG. 4; D6/328; 40/322

See application file for complete search history.

(56) References Cited

U.S. PATENT DOCUMENTS

| | | | | | |
|---|---|---|---|---|---|
| 924,763 | A | * | 6/1909 | Grant | 223/88 |
| 2,113,394 | A | * | 4/1938 | Biri et al. | 223/88 |
| 2,391,661 | A | * | 12/1945 | Watkins et al. | 223/88 |
| 3,225,978 | A | * | 12/1965 | Wach | 223/91 |
| 3,963,154 | A | * | 6/1976 | Schwartz et al. | 223/85 |
| 4,074,838 | A | * | 2/1978 | Blasnik et al. | 223/85 |
| 4,863,078 | A | * | 9/1989 | Bengsch | 223/85 |
| 5,417,352 | A | * | 5/1995 | Jen | 223/85 |
| 5,480,075 | A | * | 1/1996 | Robinson | 223/88 |
| 5,573,151 | A | * | 11/1996 | Fildan | 223/96 |
| 5,595,386 | A | * | 1/1997 | Parsons | 463/47.7 |
| 5,603,438 | A | * | 2/1997 | Jugan | 223/89 |
| 5,613,630 | A | * | 3/1997 | Isenga et al. | 223/88 |

(Continued)

FOREIGN PATENT DOCUMENTS

DE 2460293 12/1974

(Continued)

*Primary Examiner*—Gary L Welch
*Assistant Examiner*—Nathan E Durham
(74) *Attorney, Agent, or Firm*—Scully, Scott, Murphy & Presser, P.C.

(57) ABSTRACT

A coordinate set hanger has a primary hanger with a first body, a hook extending upward from the first body, a first means for suspending a garment from the first body, and a first connection tab extending downward from the body, operative to releasably suspend a dependent hanger therefrom. A connection link having a locking end at each end thereof, the locking end having at least one snap lock with at least one horizontal surface is releasably attachable to at least a connection tab of a primary hanger. A dependent hanger has a body and a second means for suspending a garment from the second body, and a second connection tab extending upward from the second body. The second connection tab is operative to releasably secure the locking end of the connecting link therein. In other embodiments, the component parts of the coordinate set hanger are modular, or may include a dependent loop for integration with existing hanger stock.

7 Claims, 5 Drawing Sheets

U.S. PATENT DOCUMENTS

| | | | | |
|---|---|---|---|---|
| 5,664,708 | A * | 9/1997 | Sacks | 223/85 |
| 6,105,834 | A * | 8/2000 | Cohen | 223/88 |
| 6,260,746 | B1 * | 7/2001 | Abdi | 223/85 |
| 6,454,145 | B1 * | 9/2002 | Russ | 223/85 |
| 6,467,658 | B1 | 10/2002 | Olk et al. | |
| D498,936 | S | 11/2004 | Gouldson | |
| D502,011 | S | 2/2005 | Gouldson | |
| 6,875,392 | B2 | 4/2005 | Olk et al. | |
| 2004/0188475 | A1 | 9/2004 | Gouldson | |
| 2005/0184108 | A1 | 8/2005 | Ho et al. | |
| 2005/0284899 | A1 * | 12/2005 | Fleming et al. | 223/85 |
| 2006/0278671 | A1 * | 12/2006 | Gouldson | 223/85 |
| 2007/0158375 | A1 * | 7/2007 | Yau | 223/85 |

FOREIGN PATENT DOCUMENTS

| | | | |
|---|---|---|---|
| DE | 3343033 | C1 * | 2/1985 |
| EP | 1707086 | | 3/2006 |
| GB | 804384 | | 2/1956 |
| GB | 1582576 | A | 9/1977 |
| GB | 2191393 | | 4/1986 |
| GB | 2296887 | | 1/1996 |
| GB | 2430613 | | 4/2007 |
| JP | A-61079419 | | 9/1984 |
| JP | U-02143076 | | 5/1989 |
| JP | U-20149571 | | 5/1989 |
| JP | 10179366 | A * | 7/1998 |
| JP | 2003116688 | | 10/2001 |

* cited by examiner

VARIABLE LENGTH COORDINATE SET HANGER

CROSS REFERENCE OF RELATED APPLICATIONS

Under 35 U.S.C. §119(e), this application claims priority of U.S. Provisional Patent Application Ser. No. 60/775,310 filed Feb. 21, 2007, entitled Variable Length Coordinate Set Hanger, the disclosure of which is hereby incorporated by reference in its entirety for all purposes.

BACKGROUND OF THE INVENTION

1. Field of Invention

The present invention relates to the field of garment hangers, and more particularly to an interchangeable garment hanger system for coordinated garment sets with a variable length attachment.

2. Description of Related Art

In the field of retail garment sales it is often desirable to display and sell a plurality of garments as a coordinated set and thus to hang them from a unitary hanger. This is particularly the case when the set of garments are sold using a so-called Garment-On-Hanger (GOH) program. GOH programs have become preferred to retailers. In a GOH program, garments are suspended from hangers by the manufacturer at the manufacturing site, and are shipped as such to retail merchants. Whereupon arrival at the retail location, the garments may be placed on the retail floor for display and sale without additional effort. Formerly, retailers accomplished the task of hanging garments from hangers with labor provided at their own expense.

Towards this end, certain special-purpose hangers have been developed to accommodate and display a coordinated set of garments. Among these are a double hanger, disclosed in United States Patent Application Publication No. 2004/0188475, published 30 Sep. 2004, by the present inventor and commonly assigned with the present application, the entire disclosure of which is hereby incorporated by its reference for all purposes. Another is a so-called bow hanger, particularly adapted for children and infants' clothing, illustrated in U.S. Design Pat. No. Des. 498,936, issued 30 Nov. 2004 to the present inventor and commonly assigned with the present application, the entire disclosure of which is hereby incorporated by its reference for all purposes. Yet another is a coordinate loop hanger, having a provision for supporting a second hanger from a loop provided beneath the body of the first, for example as disclosed in U.S. Pat. No. 6,875,932, issued 05 Apr. 2005 to Olk, et al., and commonly assigned with the present application, the entire disclosure of which is hereby incorporated by its reference for all purposes. Finally, a coordinate gripper or similar style hanger has a loop in substitution for a hook, the loop being adapted to depend from the base of the hook of another hanger. A coordinate gripper hanger is illustrated for example in U.S. Design Pat. No. Des. 502,011, issued 22 Feb. 2005 to the present inventor and commonly assigned with the present application, the entire disclosure of which is hereby incorporated by its reference for all purposes.

Each of these hangers suffers from a particular drawback. In the case of the double hanger and bow hanger, these are poorly suited for other purposes and/or wasteful and overly expensive if desired to be reused for a single garment top, for example. Additionally, their dimensions are fixed for the given application. The hanger is unsuitable to be reused for a different type or set of garments that would benefit from different dimensions or configurations. Instead, an entirely new hanger must be provided.

A gang or plurality of coordinate loop hangers is less than ideal because the even though the full size hook of the depending hanger allows the depending hanger to be used separately for other applications, the size and bulk of the hook is wasteful, and not necessary when used as a depending hanger.

The coordinate griper hanger and those of a similar loop style can be less than ideal because they too are fixed in dimension, particularly in the length of the drop or the step between the hanger body and the upper loop. The length of drop is selected to accommodate one particular coordinate set or group of sets of clothing, and use with any others may be unsuitable. This style also suffers from the drawback that it does not secure the dependent hanger to the superior hanger. Instead it relies on gravity to hold the dependent hanger in place, and the dependent hanger may be easily jostled or even dislodged from the superior hanger.

BRIEF SUMMARY OF THE INVENTION

Therefore, in order to address these and other deficiencies in the art, provided according to the present invention is a coordinate set hanger having a primary hanger with a first body, a hook extending upward from the first body, a first means for suspending a garment from the first body, and a first connection tab extending downward from the body, operative to releasably suspend a dependent hanger therefrom. A connection link having a locking end at each end thereof, the locking end having at least one snap lock with at least one horizontal surface is releasably attachable to at least a connection tab of a primary hanger. A dependent hanger has a body and a second means for suspending a garment from the second body, and a second connection tab extending upward from the second body. The second connection tab is operative to releasably secure the locking end of the connecting link therein.

The means for suspending a garment from the body may be a laterally extending arm, a pinch grip, a plural finger gripper arrangement, and a trouser bar. The locking end preferably includes a recess in the surface of the locking end on an opposite side from the snap lock.

In an alternate embodiment of the present invention, a modular dependent loop hanger includes a dependent loop portion having a closed loop at one end thereof, a shaft extending from the closed loop to a locking end of the dependent loop portion, the locking end having at least one snap lock with at least one horizontal surface, a dependent hanger having a body and a means for suspending a garment from the body, and a connection tab extending upward from the body. The connection tab is operative to releasably secure the locking end of the connecting link therein. The closed loop may include a reduced thickness portion.

In a further embodiment of the present invention, a modular coordinate set hanger includes a modular hook having a first retaining band offset from a first retaining surface, and a first horizontal surface, the modular hook operative to receive and releasably retain a locking end of another component of the modular coordinate set hanger. A first modular hanger body includes first means for suspending a garment from the body and a first connection tab extending upward from the hanger body, the first connection tab having a locking end, with at least one snap lock with at least one horizontal surface, and a second retaining band offset from a second retaining surface, and a second horizontal surface, the first connection tab operative to receive and releasably retain a locking end of another component of the modular coordinate set hanger.

The modular hanger body can also include a second connection tab extending downward from the first hanger body, operative to receive and releasably retain a locking end of another component of the modular coordinate set hanger. An optional connection link having a locking end at either end thereof, is releasably securable to one or more of the modular hook and the first modular hanger body.

The modular coordinate set hanger preferably includes a second hanger body, preferably having the features recited with respect to the first hanger body. The modular hook can be provided with structure to receive and retain an indicator.

BRIEF DESCRIPTION OF THE DRAWINGS

These and other features, advantages and benefits of the present application will be made apparent with reference to the following detailed description and accompanying figures, wherein like reference numerals refer to like features across the several views, and wherein.

DETAILED DESCRIPTION OF THE INVENTION

Figure 1:
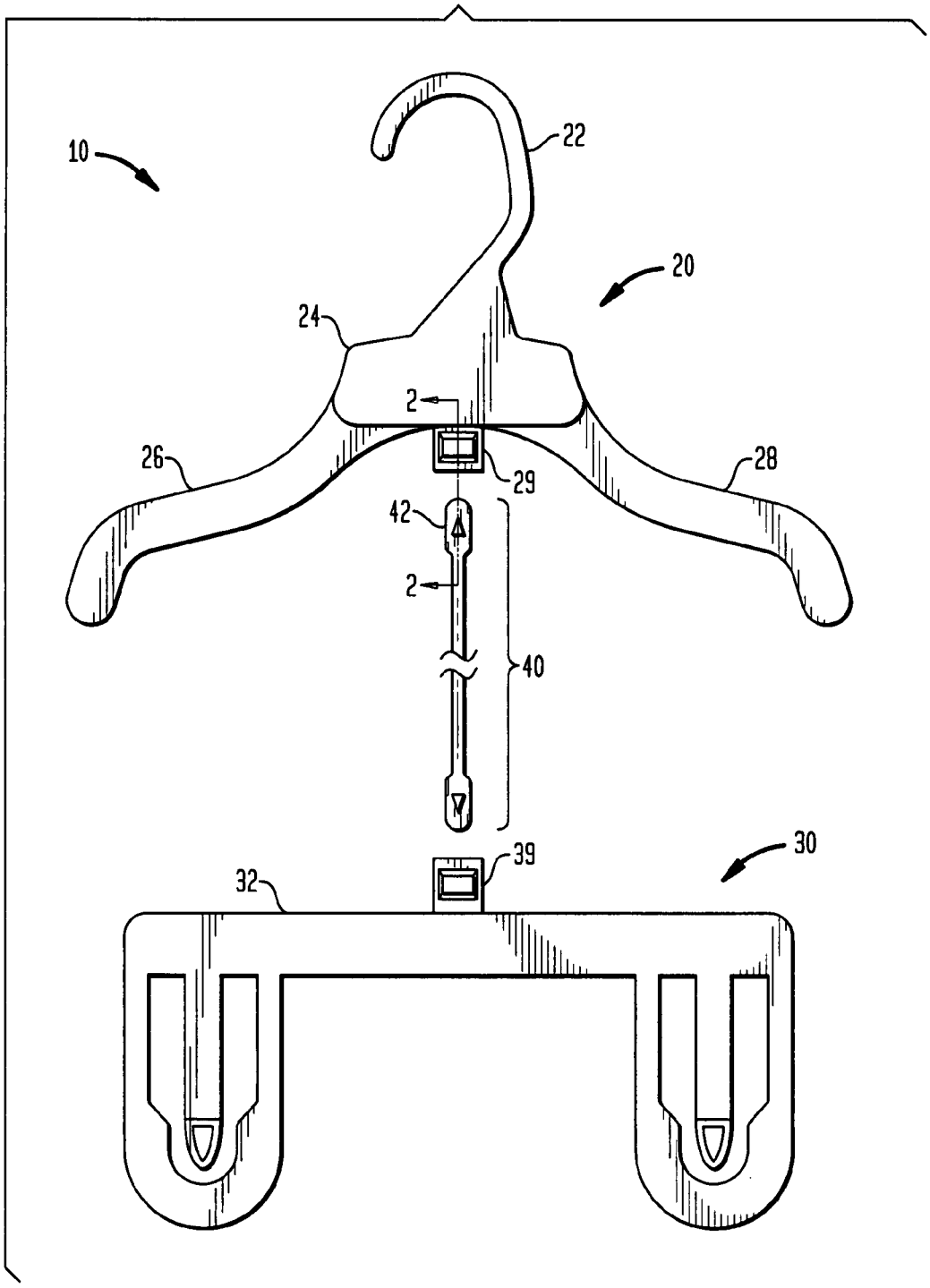
FIG. 1 illustrates a front elevation exploded assembly view of a variable length coordinate set hanger according to a first embodiment of the present invention.

Referring now to FIG. 1, illustrated in front elevation is an exploded assembly view of a variable length coordinate set hanger, generally 10, according to a first embodiment of the present invention. The coordinate set hanger 10 has a primary hanger 20, a dependent hanger 30, and a connection link 40. The primary hanger 20 includes a hook 22 extending upward from a body 24, and lateral arms 26, 28 extending outward from the body in generally opposite directions. The primary hanger also includes a connection tab 29 for receiving and holding a locking end 42 of the connection link 40 or a dependent hanger 30, as will be explained in further detail, infra.

Primary hanger 20 in this example is a garment top hanger, for shirts, blouses, sweaters, coats, jackets, and the like, but in application can be nearly any hanger style. In this case, the arms comprise a means for suspending a garment from the primary hanger 20. However, in alternate embodiments, such means for suspending a garment from the hanger may comprise plural finger grippers as on dependent hanger 30 among other resilient garment clip styles, a trouser bar, or pinch grips, in any of the many forms as are known in the art.

Dependent hanger 30 is, in this exemplary embodiment, a gripper-type hanger, but in practice may be nearly any hanger style. Dependent hanger 30 has a connection tab 39 extending upward from its body 32. Connection tab 39 is inverted, but otherwise identical to connection tab 29, and receives and holds a locking end 42 of the connection link 40.

Connection link 40 has a locking end 42 on each end thereof, and a shaft 44 joining the locking ends 42. Shaft 44 may be any arbitrary length. In preferred embodiments, a variety of connection links 40 may be provided in multiple lengths to be interchanged as dictated by the needs of the application.

As described, infra, connection tabs 29, 39, and locking ends 42, are configured as complementary mating parts of an interlock system, generally female and male, respectively. However, without departing from the scope of the present invention, the components may be reversed, i.e., either or both the connection tabs 29, 30 configured as the male component, and either or both locking ends 42 configured as the female components. Moreover, according to alternate embodiments of the present invention, connection tabs 29, 39 and/or locking ends 42 can be configured for universal adaptability as either or both female and male ends, further increasing utility.

Furthermore, the complementary mating parts may be provided in any configuration which permits interlocking the various contemplated hangers with the varying length connecting links or other hangers directly. Hangers and connecting links therefore may carry either male or female mating parts or both in case of connecting links. Alternatively, the mating parts of the interlocking system are universal.

Figure 2:
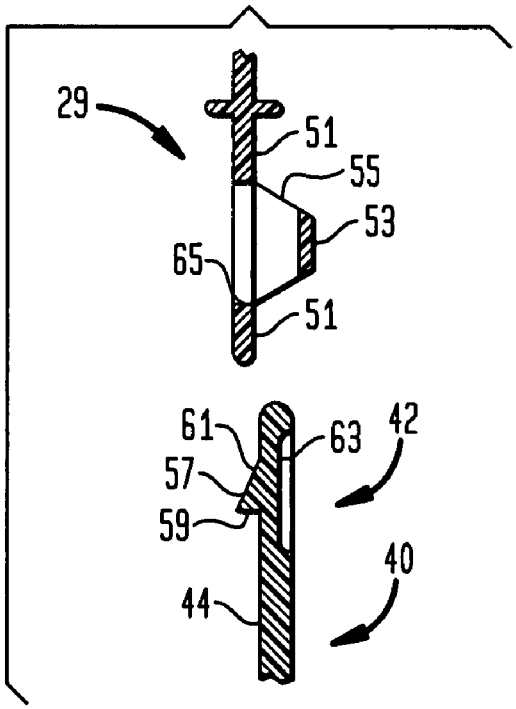
FIG. 2 illustrates a cross-section taken along line 2-2 of FIG. 1.

Referring now to FIG. 2, illustrated is a cross-section taken along line 2-2 of FIG. 1. Connection tab 29 has two generally coplanar retaining surfaces 51 vertically separated from one another and an offset retaining band 53 out of the plane of the retaining surfaces 51. Retaining band 53 is joined to the connection tab 29 by at least one, extension 55, but preferably two, with one on each end of the retaining band 53, as in the exemplary embodiment.

The locking end 42 of connection link 40 has a snap-lock 57 extending from one side. The snap-lock 57 has a horizontal surface 59 on an underside. To engage the connection link 40 with the connection tab 29, the locking end 42 is inserted into the connection tab 29 between the retaining surface 51 and the offset retaining band 53. Either of both of the snap-lock 57 and the retaining surface 51 defect to pass one another on insertion of the locking end 42. This deflection is aided by a sloped surface 61 of the snap-lock 57 and a void of material 63 formed in the locking end 42 opposite the snap-lock 57, either or both of which may optionally be present in the locking end 42.

Once the snap-lock 57 is above the lowermost retaining surface 51, the horizontal surface 59 of the snap-lock 57 engages a complementary horizontal surface 65 of the connection tab 29. This interlock between surfaces 59 and 65 is generally resistant to removal without the application of considerable force, or by use of a tool specially designed for that purpose, and is therefore considered child-proof according to industry standards, for example those promulgated by the Voluntary Inter-industry Commerce Standards Association (VICS) or Bureau Veritas Consumer Product Services, Inc.

In the embodiment of FIG. 1, connection tab 39 is inverted with respect to connection tab 29, but otherwise identical in form and function. The connecting link 40 has locking ends 42 at both ends, therefore can function in either vertical orientation. Optionally, the locking end 42 may be provided with snap-lock 27 on both a front and a back side, so that the locking end 42 can engage the connection tab 39 in any of an upright, inverted, front-facing or rear-facing orientation. Moreover, dependent hanger 30 can include a further connection tab depending from beneath the body 32 for the attachment of additional connection links 40 and/or depending hangers 30.

Figure 3:
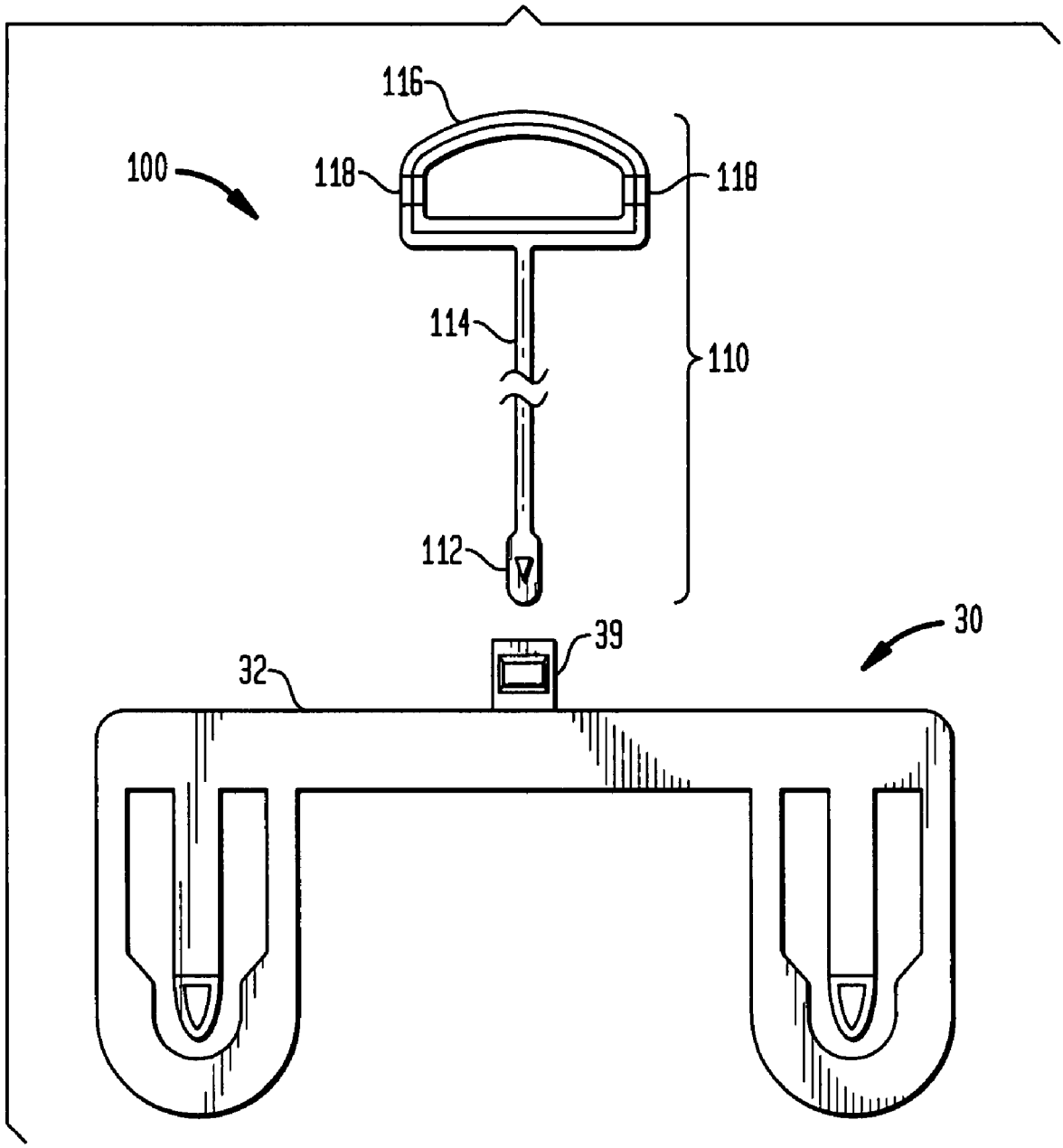
FIG. 3 illustrates a front elevation exploded assembly view a variable length coordinate hanger according to a second embodiment of the present invention.

Referring now to FIG. 3, illustrated in front elevation is an exploded assembly view of a variable length coordinate hanger, generally 100, according to a second embodiment of the present invention. It this embodiment, it may be desirable to integrate hangers according to the present invention with others already in use. Therefore, according to an alternate embodiment, a coordinate hanger 100 includes a dependent hanger 30, again in this exemplary embodiment a gripper-type hanger, but in practice may be nearly any hanger style.

A dependent loop 110 has a locking tab 112 at a lower end, which will be understood as equivalent to the locking tabs 42 described in the forgoing embodiment. A shaft 114 extends from the locking end 112 to a closed loop 116. In use, the closed loop 116 may be placed over the hook of a primary hanger to support the variable length coordinate hanger 100. Closed loop 116 also includes a reduced thickness portion 118 to accommodate the body of the primary hanger, optionally front and back as in this embodiment. The reduced thickness portion 118 reduces the amount by which the dependent loop 110 protrudes out of the plane of the primary hanger.

Figure 4:
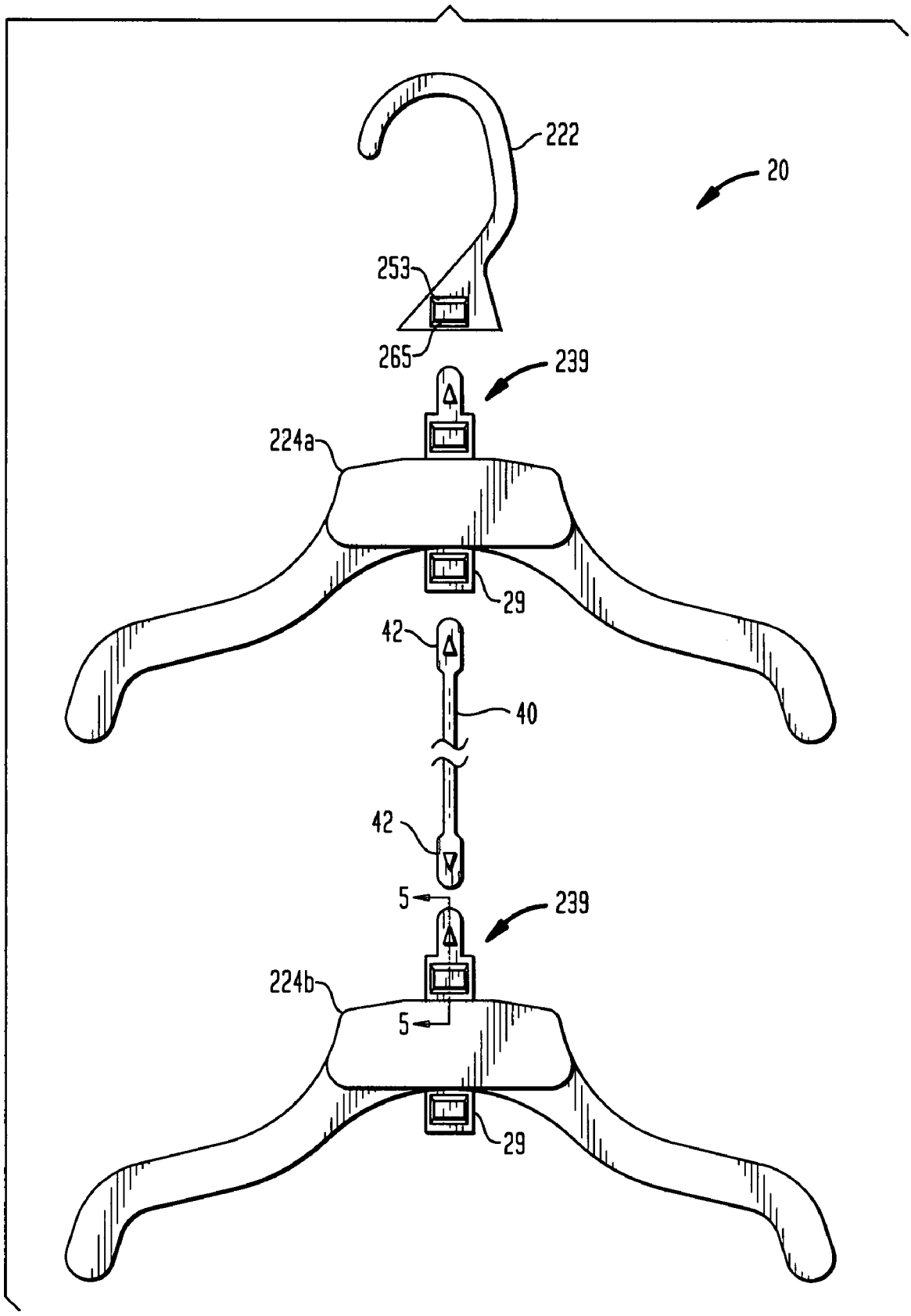
FIG. 4 illustrates a front elevation exploded assembly view a coordinate set hanger according to yet another embodiment of the present invention.

Referring then to FIG. 4, illustrated is a front elevation exploded assembly view of a coordinate set hanger, generally 200, according to yet another embodiment of the present invention. In this embodiment a modular hook 222 is detachable from a first modular hanger body 224*a*. First modular hanger body 224*a* is connected to a second modular hanger body 224*b* by connection link 40. First and second modular hanger bodies 224*a*, 224*b*, in this embodiment, will be seen as identical, and reference to the whole or part of either by numeral alone, e.g., 224, will suffice to describe both. Moreover, either or both modular hanger bodies 224*a*, 224*b* could be replaced by a gripper-type hanger body, or any other style of hanger body, according to the style of clothing making up the coordinate set to be hung.

Each modular hanger body 224 has a connection tab 29 depending from beneath it. Connection tab 29 is operative to receive and hold a locking end 42 of the connection link 40. Extending upward from the body 224 is a connection tab 239. Connection tab 239 is operative to receive and hold a locking end 42 of the connection link 40. Connection tab 239 is also operative to be inserted directly into a corresponding connection tab 29 directly to be received and held, without a connecting link 40.

Modular hook 222 includes a retaining band 253, and a horizontal surface 265. Retaining band 253 and horizontal surface 265 will be seen as analogous to retaining band 53 and horizontal surface 65 of connection tab 29 (See, FIG. 2). The modular hook 222 is therefore operative to receive and hold a connection tab 239, or a locking end 42 of a connection link 40. According to the illustrated embodiment the modular hook 222 has no particular provision to receive and retain a detachable indicator, however, such features can be provided in a manner known in the art. In that case, according to the present invention, the style of sizing indicator can be altered on a particular hanger by merely interchanging a modular hook 222 thereof.

Figure 5:
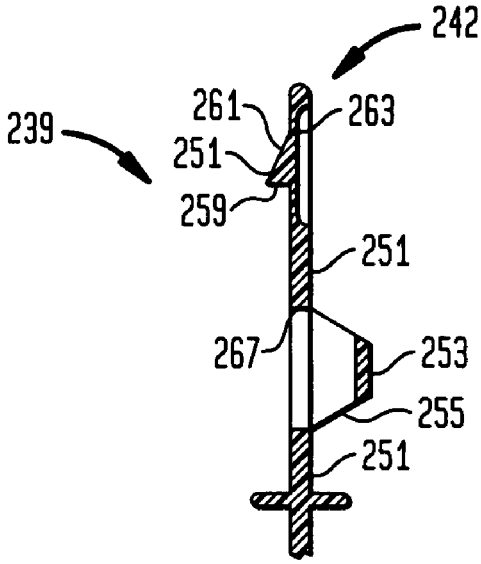
FIG. 5 illustrates a cross-sectional view taken along line 5-5 of FIG. 4.

Referring now to FIG. 5, illustrated is a cross-sectional view of the connection tab 239 taken along line 5-5 of FIG. 4. Connection tab 239 has features common with both connection tab 39 and also with locking end 42. The connection tab 239 has two generally coplanar retaining surfaces 251 vertically separated from one another and an offset retaining band 253 out of the plane of the retaining surfaces 251. Retaining band 253 is joined to the connection tab 29 by at least one extension 255, but preferably two, with one on each end of the retaining band 253, as in the exemplary embodiment. A horizontal surface 267 engages the horizontal surface 59 of a locking end 42 when the locking end 42 is inserted between the retaining surfaces 251 and the band 253.

The locking end 242 of connection tab 239 has a snap-lock 257 extending from one side. The snap-lock 257 has a horizontal surface 259 on an underside. The connection tab 239, and specifically the locking end 242 thereof, is engaged with a connection tab 29 as described with respect to the earlier embodiment. It will be appreciated that modular hanger 220, or any style of hanger having a connection tab 239 is useful with the embodiment of FIG. 1, for example as a dependent hanger. Finally, the connection tab 239 may also be provided without provision to receive and retain a locking end 42, in which case it is still useful for direct connection to a connection tab 29 without use of a connecting link 40.

Therefore, according to the foregoing embodiment of the present invention, the functions of several different styles of hanger may be performed by the modular system shown. The type of hook sizing indicia can be altered by merely substituting a modular hook 222, rather than having a dedicated hanger model for each sizing type. A garment for a single hanger can be provided, for example by the combination of a modular hook 222 and modular hanger 220. That same hanger can be converted to a coordinate set hanger 200 by the addition of second modular hanger 220, and optionally a connecting link 40, of nearly any arbitrary length. Accordingly, the total number of component parts necessary to serve a wide variety of hanger needs is substantially reduced. Moreover, each hanger may be more easily recycled and reused to a new and different use as modular components, for example in a hanger recycling program as disclosed in U.S. Pat. No. 6,523,240 to the present inventor and commonly assigned with the present application, to complete disclosure of which is hereby incorporated by its reference for all purposes.

Figure 6:
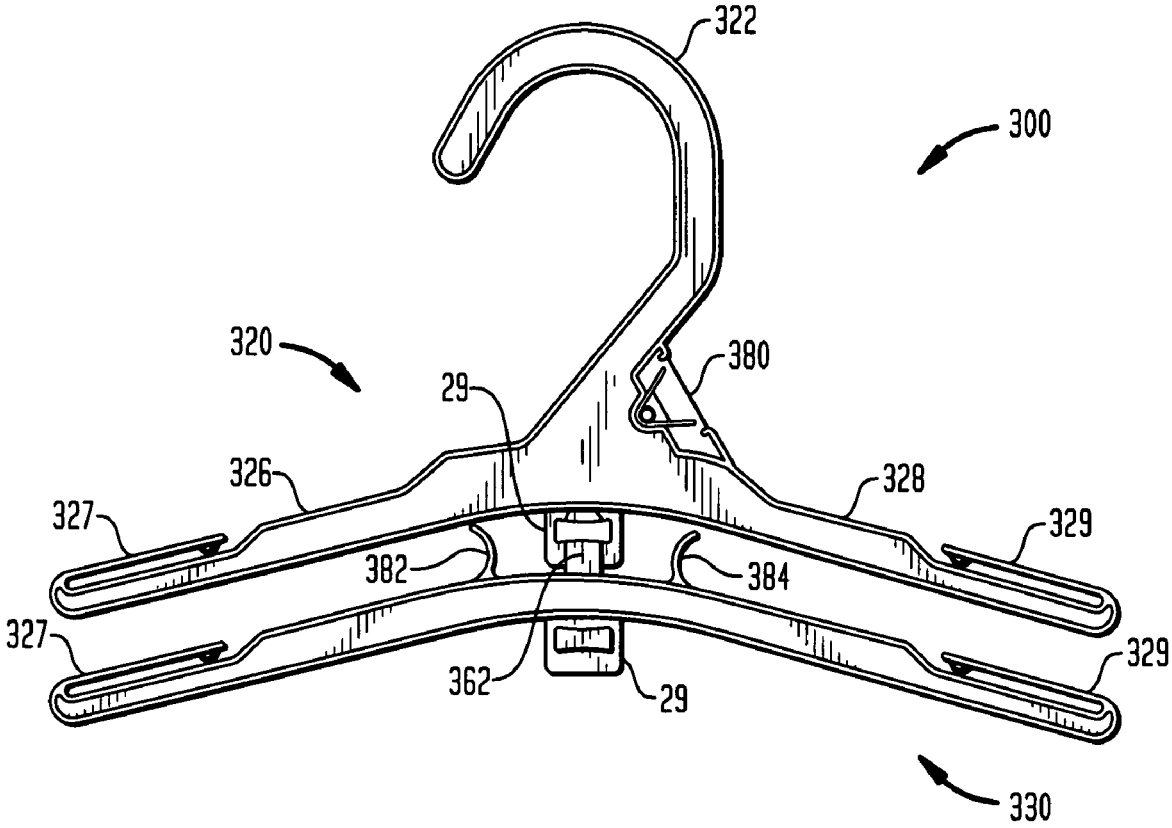
FIG. 6 illustrates a front elevation view of a coordinate set hanger according to yet another embodiment of the present invention.

Referring now to FIG. 6, illustrated in front elevation view is a modular coordinate set hanger, generally 300, according to a further embodiment of the present invention. The modular coordinate set hanger 300 includes a primary hanger 320, and a dependent hanger 330. In this embodiment, both are configured as top hangers, though this may be varied, as described above. The features of the modular coordinate set hanger 300 that are common to earlier embodiments will not be described in detail.

Primary hanger 320 includes a hook 322, and is also configured to releasably secure a side-sizer on web 380, as generally described for example in U.S. Pat. No. 6,264,075 to Stanley F. Gouldson, commonly assigned with the present application, the complete disclosure of which is hereby incorporated by its reference for all purposes. Arms 326, 328 of the primary hanger 320 and or the secondary hanger can be provided with clips 327, 329 to aid in retaining a garment suspended from the respective hanger.

Primary hanger 320 includes a connection tab 29, in this case a female mating part, which receives and releasably secures a corresponding male mating part at locking end 362 on an upper side of the dependent hanger 330. Dependent hanger 330 further includes a connection tab 29 to relesable secure additional dependent hangers 330, or alternately a connection link as described in the foregoing embodiments. Dependent hanger 330 further includes a pair of gripping tabs 382, 384, to aid in grasping the dependent hanger 300, for example on attachment or removal from the primary hanger 320. It will be appreciated that the connection tabs 29 and or locking end 362 may be interchanged male for female, or made universal, without departing from the scope of the present invention.

As is typical in the industry, garment hangers or any portion thereof disclosed herein may be formed in whole or in part of an injection molded plastic, more commonly a rigid plastic such as polystyrene, SAN, ABS, PPO, nylon, polypropylene (PP), polyethylene, PET, polycarbonates (PC), acrylics, K resin, and polyvinyl chloride (PVC) among others.

The present invention has been described herein with reference to certain exemplary or preferred embodiments. These embodiments are offered as merely illustrative, not limiting, of the scope of the present invention. Certain alterations or modifications may be apparent to those skilled in the art in light of instant disclosure without departing from the spirit or scope of the present invention, which is defined solely with reference to the following appended claims.

The invention claimed is:

1. A coordinate set hanger comprising:

a first hanger having a first body, a hook extending upward from the first body, a first means for suspending a garment from the first body, and a first connection tab extending downward from the first body and operative to releasably suspend a dependent hanger therefrom;

a connection link having a first locking end at one end thereof and a second locking end at the other end thereof, the first locking end being releasably attachable to the first connection tab; and a dependent hanger having a second body and a second means for suspending a garment from the second body, a second connection tab extending upward from the second body, the second connection tab operative to releasably secure the second locking end of the connection link thereto, wherein the first and second connection tabs comprise at least one of two complementary male or female mating parts and first and second locking ends comprise at least the other one of two complementary male or female mating parts, wherein the male mating part comprises:

an elongated body having a first substantially vertical surface and an opposite second substantially vertical surface, and a snap lock defined by a sloped surface extending away from the first substantially vertical surface, and a first substantially horizontal surface connecting the first substantially vertical surface and the sloped surface, and wherein the female mating part comprises:

a substantially vertical retaining surface for engaging the sloped surface of the snap lock when the male part engages the female part, a retaining band spaced from the substantially vertical retaining surface, for providing a space receiving the elongated body and the snap lock of the male part when the male part engages the female part, and a second substantially horizontal surface for engaging the first substantially horizontal surface of the snap lock of the male mating part when the male part engages the female part.

2. The coordinate set hanger according to claim 1, wherein the male mating part further comprises a recess formed in the second substantially vertical surface for facilitating deflection of the snap lock.

3. The coordinate set hanger according to claim 1, wherein one of the a first and second means for suspending a garment from the body comprises one or more of a laterally extending arm, a pinch grip, a plural finger gripper arrangement, and a trouser bar.

4. A modular coordinate set hanger, comprising:

a modular hook having an integral connection tab; and a first hanger, comprising:

a hanger body having a pair of hanger arms extending oppositely from each other;

a first connection tab extending upward from the hanger body; and a locking end associated with the first connection tab, wherein the integral connection tab of the modular hook and the locking end of the first hanger comprise complementary female and male mating parts, respectively, and the first connection tab of the first hanger comprises a female mating part, wherein the male mating part comprises:

an elongated body having a first substantially vertical surface and an opposite second substantially vertical surface;

a snap lock defined by a sloped surface extending away from the first substantially vertical surface and a first substantially horizontal surface connecting the first substantially vertical surface and the sloped surface; and a recess in the second vertical surface for facilitating deflection of the snap lock, and wherein the female mating part comprises:

a substantially vertical retaining surface for engaging the sloped surface of the snap lock when the male part engages the female part;

a retaining band spaced from the substantially vertical retaining surface, for providing a space receiving the elongated body and the snap lock of the male part when the male part engages the female part; and a second substantially horizontal surface for engaging the first substantially horizontal surface of the snap lock of the male mating part when the male part engages the female part.

5. The modular coordinate set hanger according to claim 4, wherein the first hanger further comprises a second connection tab extending downward from the hanger body, the second connection tab comprising a female mating part.

6. The modular coordinate set hanger according to claim 5, further comprising at least one connection link, wherein the connection link comprises an elongate body and a pair of locking ends, each of said pair of locking ends comprising a male mating part, complementary to the female mating part of the integral connection tab of the modular hook and the first and second connection tabs of the first hanger.

7. The modular coordinate set hanger according to claim 6, further comprising at least one second hanger, wherein the second hanger comprises:

a hanger body having a pair of hanger arms extending oppositely from each other;

a connection tab extending upward from the hanger body;

a locking end associated with the connection tab; and a further connection tab extending downward from the hanger body of the at least one second hanger, wherein the locking end of the at least one second hanger comprises a male mating part, complementary to the female mating part of the integral connection tab of the modular hook and the second connection tab of the first hanger;

the connection tab of the at least one second hanger comprises a female mating part, complementary to the male mating part of the locking ends of the connection link; and the further connection tab of the at least one second hanger comprises a female mating part, complementary to the male mating part of the locking ends of the connection link and the male mating part of the locking end of the first hanger.

* * * * *